United States Patent [19]

Jenkins

[11] 3,940,143

[45] Feb. 24, 1976

[54] GOLF GAME DEVICE

[76] Inventor: Owen E. Jenkins, 3318 River Forest Drive, Fort Wayne, Ind. 46805

[22] Filed: Dec. 12, 1974

[21] Appl. No.: 531,998

[52] U.S. Cl. ..... 273/178 R; 273/185 R
[51] Int. Cl.[2] ..... A63B 69/36; A63B 57/00
[58] Field of Search ..... 273/177, 178, 179, 184, 273/185, 180, 127 R, 127 B, 127 C

[56] References Cited

UNITED STATES PATENTS

| | | | |
|---|---|---|---|
| 1,961,060 | 5/1934 | McCarthy | 273/184 A X |
| 2,443,759 | 6/1948 | Anderson | 273/179 A |
| 2,508,701 | 5/1950 | Barnett | 273/177 R |

*Primary Examiner*—George J. Marlo

[57] ABSTRACT

A game structure for guiding, receiving, and retaining in various scoring regions a game playing object. The framework is adapted to be mounted on a game playing surface, such as a household carpet. The game playing object may be a golf ball, stroked with a golf putter toward the framework structure to achieve scoring by proper placement in the scoring regions. Three substantially co-planar open-sided frames, one inside another, are connected to define scoring regions. The frames are made of bar stock and are rigid, easily disassembled for compact storage, are play stable, adjustable to vary the game skill required, and separable for game versatility. A ramp is provided over which the game playing object is propelled, the ramp height being adjustable by a frictional device.

6 Claims, 4 Drawing Figures

GOLF GAME DEVICE

BACKGROUND OF THE INVENTION

1. Field of the Invention

This invention relates to a game adapted for placement on a playing surface, adapted to receive a game object such as a ball propelled by a player, and having scoring regions for the game object defined by segments of a framework.

2. Description of the Prior Art

Numerous golf game playing devices have been designed in the past which are surface mounted. Certain of these prior devices have lacked durability, flexibility of play, ease of assembly and storage capability. The construction material of these prior devices has largely been of a plastic which was unsatisfactory in many respects due to its propensity for breaking, warpage, and lack of requisite weight for position stability during game play.

SUMMARY OF THE INVENTION

This invention provides a sturdy, easily disassembled framework for use on a game playing surface to receive a game playing object. The framework is subdivided into a plurality of scoring regions and is adjustable to vary game playing skill requirement. Preferably, the game playing surface is a carpet and the game playing object is a golf ball that is propelled by a golf putter controlled by the player. The game improves golf playing skill while adding the interest of game scoring objectives and is designed for competitive play.

A framework, preferably of bar stock, has a first open-sided retaining and guiding frame having two parallel sides connected by a cross end member. Placed interiorly of the first frame is a second frame having parallel legs connected intermediately along the length thereof by a cross arm thus forming an "H" configuration. At one end the legs are shaped in the form of inverted U's or hooks which are placed over and frictionally engage the cross end member. This provides a relatively simple vertical adjustment of the legs and the cross arm; the vertical height of the cross arm varies the skill required in playing of the game. The region enclosed by the cross end, parallel legs and cross arm is a penalty area. Lowering the height of the cross arm lowers the barrier over which the ball must travel to enter the penalty area hence placing a greater premium on the precision with which the ball is stroked.

A third guiding and retaining frame is placed centrally of the second frame and is defined by a first set of segments which are generally parallel. A second set of segments is connected to the first set and converge therefrom. The second set of segments is connected to a third set of segments which are only slightly convergent. The third set of segments are finally connected to a circular ring member which defines a high scoring region. The third set of segments is inclined upwardly toward the ring member to provide a ramp over which the ball must roll to enter the high scoring region. The rearward portion of the ring contour abuts the cross arm member and is vertically adjustable to control the barrier height to the penalty area encountered by a game ball.

It is therefore an object of this invention to provide a game playing framework which may be easily assembled and disassembled, is durable, is relatively rigid, is relatively immovable on a game playing surface, has a simple mechanism for game playing adjustments that is relatively easy to operate, and has game playing flexibility.

A further object of this invention is to provide a game playing framework of the foregoing object which defines scoring regions separated by the framework structure and which is used with a golf ball and golf putter to improve golfing skill as well as provide game scoring objectives and provide for competitive game play.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
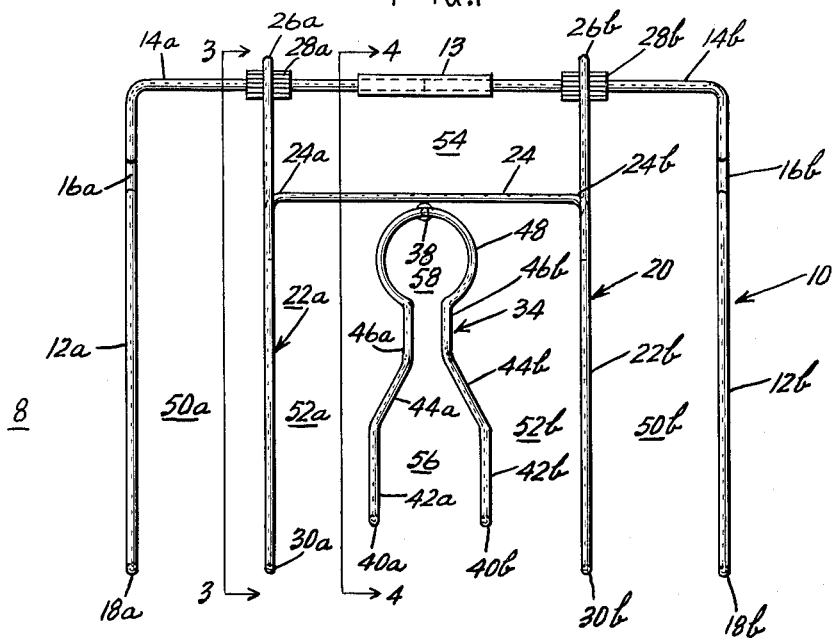
FIG. 1 is a top plan view of the framework of this invention.
Figure 2:
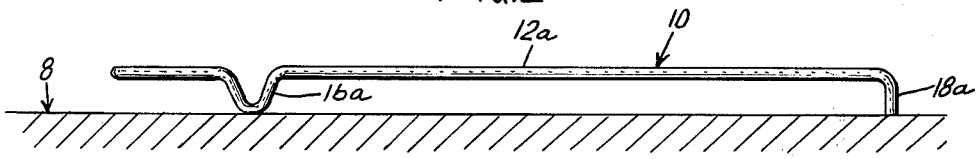
FIG. 2 is a side view of the outer frame.
Figure 3:
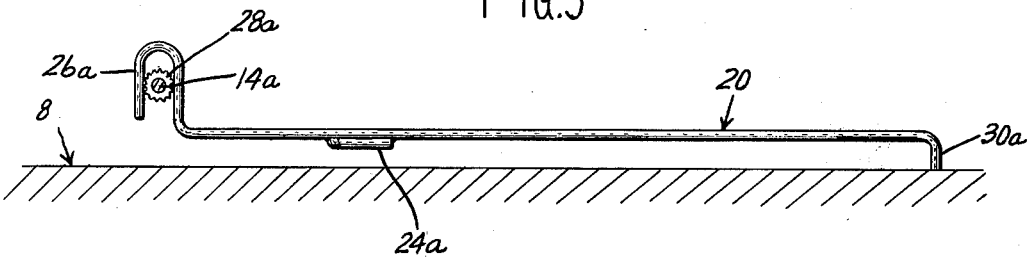
FIG. 3 is a sectional view taken substantially along section line 3—3 of FIG. 1 showing a side view of the intermediate frame, the other frame members not being fully shown.
Figure 4:
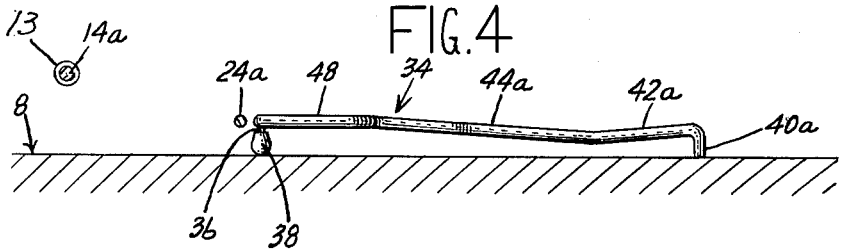
FIG. 4 is a sectional view taken substantially along section line 4—4 of FIG. 1 showing a side view of the center frame, the other frame members not being fully shown.

Referring to FIG. 1, guiding and retaining frame 10 comprises two L-shaped members having parallel sides 12*a* and 12*b* and a cross end member comprising sections 14*a* and 14*b* joined at their respective ends by plastic sleeve 13. Sides 12*a* and 12*b* are preferably made of metallic bar stock, as are the other frame members to be described, and have U-shaped formations 16*a* and 16*b*, respectively, formed at the rearward ends thereof. Feet 18*a* and 18*b* are formed at the forward ends of sides 12*a* and 12*b*, respectively, by bending the forward ends downwardly to provide a four point support for frame 10 on playing surface 8. Preferably, playing surface 8 is a carpet material or the like simulating a putting green.

Placed interiorly of frame 10 is a second frame 20 comprising parallel legs 22*a* and 22*b* which are joined, as by welding, to cross arm 24 at points 24*a* and 24*b*, respectively, thus forming an H-shaped structure. At the rear ends of legs 22*a* and 22*b* are inverted U-shaped members or hooks 26*a* and 26*b*, respectively, which fit over and are in frictional engagement with elastic sleeves 28*a* and 28*b*, respectively, of rubber or the like telescoped over sections 14*a* and 14*b*. Sleeves 28*a* and 28*b* preferably have corrugated outer surfaces so that the vertical height of frame 20 is adjustable by the movement of hooks 26*a* and 26*b* on sleeves 28*a* and 28*b*, respectively. Due to the frictional engagement between the legs of hooks 26*a* and 26*b* with the sleeves 28*a* and 28*b*, frame 20 will be held in the position to which it is adjusted. The forward ends of legs 22*a* and 22*b* are downwardly turned to form feet 30*a* and 30*b*, respectively, which are in contact with and provide vertical spacing from playing surface 8 for the forward end of frame 20.

Fitted centrally in frame 20 is a third frame member of bar stock 34 having parallel segments 42*a* and 42*b* supported at their forward ends by downwardly turned feet 40*a* and 40*b*, respectively, for contacting surface 8. Segments 42*a* and 42*b* are connected at their rearward ends to converging segments 44*a* and 44*b*, respectively, which in turn are connected to converging segments 46*a* and 46*b*, respectively, which have a smaller converging angle and are spaced apart a distance less than the diameter of a golf ball. Segments 46*a* and 46*b* are connected to circular member 48, simulating a golf cup, which has a vertical post 36 depending from the rearward end thereof and frictionally fitted into an elastic cup 38 of rubber or the like to provide a vertical adjustment of the rearward end of frame 34. Cup 38 rests on playing surface 8.

The scoring regions defined by the framework elements will now be explained. Scoring region 50*a* is bounded by side 12*a*, cross end section 14*a*, and leg 22*a*. Region 50*b* is defined by leg 22*b*, cross end section 14*b*, and side 12*b*. Region 52*a* is defined by leg 22*a*, cross arm 24, circular section 48, segments 46*a*, 44*a* and 42*a*. Region 52*b* is defined by segments 42*b*, 44*b*, 46*b*, circular section 48, cross arm 24 and leg 22*b*. Region 54 is defined by leg 22*a*, cross end members 14*a*, 14*b*, leg 22*b*, and transverse arm 24. Region 56 is defined by segments 42*a*, 44*a*, 46*a*, 46*b*, 44*b* and 42*b*. Region or golf cup 58 is defined by circular member 48. Golf cup 58 is the highest scoring region followed in reduced amounts by regions 52*a*, 52*b*, and regions 50*a*, 50*b*. Region 56 is a blocking region and region 54 is a penalty region.

The game playing apparatus shown in the drawings may be used as a golf putting game. The game is ordinarily played by multiple players with an equal number of players on opposing sides. The apparatus is positioned on a playing surface, such as a carpet, a suitable distance from the players. The players putt a golf ball, not shown, toward the open side of the framework 10 attempting to reach the cup 58. In order to reach cup 58, the ball must be rolled up the ramp formed by segments 46*a*, 46*b*. However, if the ball is stroked with too much force, it will continue over cup 58 and arm 24 into the penalty area 54 which counts a minus score. The vertical height of circular section 48 and arm 24 may be adjusted as previously described to provide a variable barrier resistance to the entry of the ball into penalty area 54. The lower the circular member 48 and arm 24 are placed, the more easily the ball will enter the penalty area 54 and the more precisely the ball must be stroked. The height of member 48 and arm 24 may be adjusted to compensate for pile height of a carpet playing surface.

The second highest scoring areas are 52*a*, 52*b* and in order to enter these areas it is necessary to direct the ball between leg 22*a* and segment 42*a* or between segment 42*b* and leg 22*b*, respectively. Again, if the ball is struck with too much force, it will roll over arm 24 into penalty area 54. The lower arm 24 is adjusted, the more precisely the ball must be stroked to keep it in scoring regions 52*a*, 52*b* and prevent it from entering penalty area 54. The lowest scoring regions are regions 50*a* and 50*b*. The ball also may be manually rolled or otherwise propelled.

The game apparatus shown in the drawing may be easily disassembled by simply lifting frame 20 from frame member 10 and separating the two sections of frame 10 by sliding either end portion 14*a* or 14*b* from sleeve 13. By forming the elements of metallic bar stock, a game of exceptional durability is provided and further, once placed on a playing surface, it will remain in place so that frequent adjustments and rearrangements are not necessary during the course of game play. A golf ball will not ordinarily disturb the alignment of the frame members as shown in the drawing. Further, the members may be used individually or in combinations shown other than that in the drawing. For example, frame section 34 may be used individually apart from the other frame sections.

While there have been described above the principles of this invention in connection with specific apparatus, it is to be clearly understood that this description is made only by way of example and not as a limitation to the scope of the invention.

What is claimed is:

1. A game playing framework adapted for placement on a playing surface and having an open side receiving a ball comprising, a first open-sided frame having a pair of sides connected to and transversely spaced by a cross end member and being adapted to rest on a playing surface and having a plurality of depending support members to support and space said frame a predetermined distance from the playing surface, a second open-sided frame being placed interiorly of said first open-sided frame and having a pair of equal length parallel legs, said legs being connected intermediately of their length and transversely spaced by a cross arm, one end of each of said legs having a hook formed thereon with the open side of each of the hooks straddling and frictionally engaging said cross end member to provide for vertical adjustment of said second frame with respect to said cross end member, the other ends of said legs having supporting members depending therefrom to support said legs a predetermined distance from the playing surface, a third open-sided frame disposed interiorly of said second frame and having a first pair of transversely spaced segments substantially parallel to said legs and defining an open side, a second pair of segments connected respectively to said first pair of segments and converging therefrom, a third pair of inclined segments connected respectively to said second pair of segments and converging at an angle smaller than said first angle and being transversely spaced a predetermined distance to form a ramp for game balls, a ring section being connected to said third pair of segments to form a cup-shaped retainer for golf balls propelled through the areas defined by said first and second pair of segments and over the ramp formed by said third pair of segments.

2. A game playing framework according to claim 1 with said cross end member having a first and a second section, a sleeve member, said first and second sections being telescoped into opposite ends of said sleeve section to hold said first and second sections together.

3. The apparatus of claim 1 with said first frame sides being substantially parallel, and said second frame parallel legs being substantially parallel to said first frame sides.

4. A game playing framework according to claim 1 with a pair of elastic sleeves, said sleeves being telescoped over and positioned on said cross end member to receive the open side of said hooks.

5. A game playing framework adapted for placement on a playing surface and having an open side for receiving a ball comprising, an open-sided frame having a first pair of substantially parallel transversely spaced segments and defining an open side, a second pair of segments connected respectively to said first pair of segments and converging therefrom, a third pair of segments connected respectively to said second pair of segments and converging at an angle smaller than said first angle and being transversely spaced a predetermined distance to form a ramp for game balls, a ring section being connected to said third pair of segments to form a cup-shaped retainer for golf balls propelled through the areas defined by said first and second pair of segments and over the ramp formed by said third pair of segments.

6. The game playing framework of claim 5 with a vertical post depending from said ring section, a socket member in a telescoping frictional relation to said post whereby said socket member may be adjusted vertically along said post to adjust the vertical height of said ring section.

* * * * *